United States Patent [19]

Ambrosi et al.

[11] Patent Number: 4,615,036

[45] Date of Patent: Sep. 30, 1986

[54] COOLING THE ELECTRODE CONNECTION IN AN ARC FURNACE

[75] Inventors: Luciano Ambrosi, Moers; Klaus von Ploetz, Kaarst; Ludger Zangs, Essen; Friedrich Nordmeyer, Mettmann, all of Fed. Rep. of Germany

[73] Assignee: Mannesmann AG, Duesseldorf, Fed. Rep. of Germany

[21] Appl. No.: 612,423

[22] Filed: May 21, 1984

[30] Foreign Application Priority Data

May 26, 1983 [DE] Fed. Rep. of Germany ..... 3319389

[51] Int. Cl.[4] ..... H05B 7/08

[52] U.S. Cl. ..... 373/93

[58] Field of Search ..... 373/88, 90–96, 373/100–101

[56] References Cited

U.S. PATENT DOCUMENTS

| | | | |
|---|---|---|---|
| 4,121,042 | 10/1978 | Prenn | 373/93 |
| 4,168,392 | 9/1979 | Prenn | 373/93 |
| 4,287,381 | 9/1981 | Montgomery | 373/93 |
| 4,442,525 | 4/1984 | Zollner | 373/93 |
| 4,451,926 | 5/1984 | Hogg, Jr. et al. | 373/93 |
| 4,481,500 | 11/1984 | Zollner et al. | 373/92 |
| 4,488,312 | 12/1984 | Montgomery et al. | 373/93 |
| 4,495,624 | 1/1985 | Reimpell et al. | 373/92 |

*Primary Examiner*—A. D. Pellinen
*Assistant Examiner*—Gregory D. Thompson
*Attorney, Agent, or Firm*—Ralf H. Siegemund

[57] ABSTRACT

An upper and a lower electrode section are mechanically interconnected through a nipple threaded into the lower electrode, as well as into a receiver on a tension rod pulling the nipple up, and thereby the lower electrode is urged against the front end of a twin wall upper electrode. The receiver is for its most parts surrounded by a twin wall sleeve passed through by cooling fluid and being suitably held within the upper electrode for axial displacement but bars intermittent contact with the receiver to obtain cooling thereof as well as of the connecting nipple.

3 Claims, 1 Drawing Figure

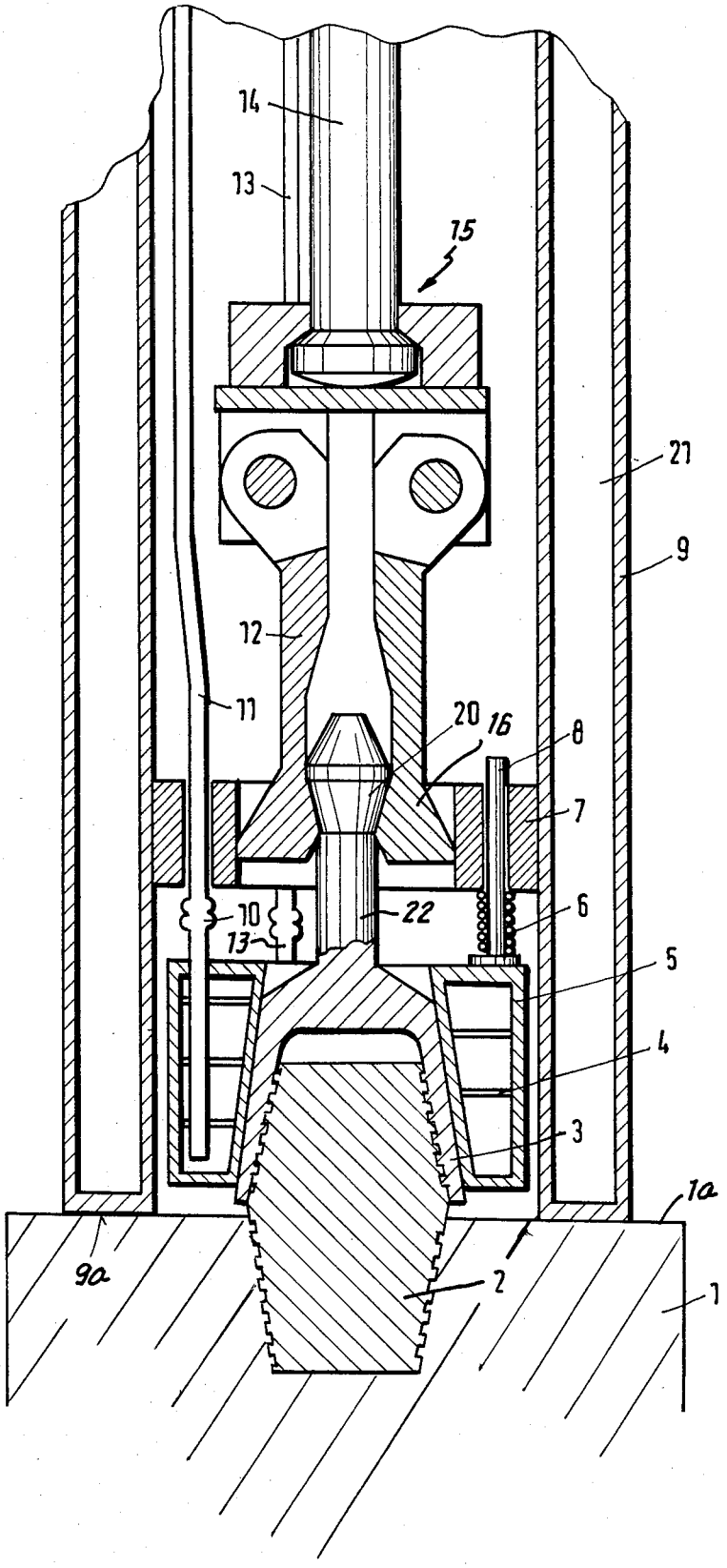
14
13
15
27
9
12
11
20
16
8
7
10
13
22
6
5
4
3
1a
9a
2
1

COOLING THE ELECTRODE CONNECTION IN AN ARC FURNACE

BACKGROUND OF THE INVENTION

The present invention relates to a structure for cooling the electrode connection in electric arc furnaces; more particularly the invention relates to the cooling of such a connection, whereby the electrodes are respectively comprised of a hollow metallic upper portion, and at least one lower portion is made, e.g., of graphite, and wherein suitable mechanical tension connection of these portions is provided while the electrical connection runs through the front faces of the electrode sections. Moreover, a connector nipple is connected to the lower electrode section, and a connecting element on the upper electrode section receives the nipple.

German printed patent application No. 2,739,483 corresponding to U.S. Pat. No. 4,121,042 generally discloses a compound or combined electrode with an upper section being cooled and made of steel, and a graphite lower section of the type outlined above. The nipple is constructed as a twin cone, and is threaded into the two sections. The nipple is also made of graphite. The main aspect here is that the coolant flow in the upper electrode section is such that the nipple is likewise adequately cooled. Cooling is quite important because particularly in the range of the neck of the nippple connector certain fractures and ruptures can occur which may interfere with the operation of the furnace. As to that particular aspect, the above-identified technology is quite adequate.

However, in practice it was found that the compound or composite electrode construction poses certain difficulties. The mutual disposition of the two electrodes is determined to a higher degree (redundancy) than necessary, i.e., through the cones and the contact front faces of the two electrode parts to be interconnected. If the cone in the upper part is tightened to the nipple, it is quite possible that the contact surfaces, i.e., the axial front ends of the two electrode section are no longer in contact. This means that the electric current which normally flows and is supposed to flow directly across the interface between the two axial front ends of the electrodes will have to flow through the nipple. Moreover, arcing may occur in the gap between the front faces of the electrodes.

In view of the fact that the mutual orientation and disposition of the two electrode parts are in fact subject to redundancy, this kind of construction will not be useable whenever the two electrode sections are in effect interconnected through tension, because this inter-relationship will almost with certainty produce the undesirable gap between the front faces of the electrode sections as outlined above. Moreover, it has to be observed that thermal extensions may occur between the intensively cooled nipple and the adjoining rather warm electrode section made of graphite. As a consequence, the shaft or shank of the nipple part may break, particularly in the thread bottom.

German printed patent application No. 3,144,926 corresponding to U.S. Pat. No. 4,495,624 discloses a graphite electrode which can be form-fittingly connected to the electrode holder of an electrofurnace. This electrode connection structure, however, is in practice always accompanied with very high temperature. This means that the tension rod head can be damaged severely. Also, the connecting piece and, particularly, the tie rod may be severely damaged. The contact-free arrangement of the electrode connection in the interior of the twin wall current conductor tube on the other hand is insufficient for adequate cooling of the connecting area and, particularly, the nipple.

DESCRIPTION OF THE INVENTION

It is an object of the present invention to provide a new and improved cooling structure for the connection between sections of a compound electrode which are interconnected through tension, whereby the cooling structure should not interfere with the contact making of the electrode section so that electric current flows exclusively across the outer surfaces of the electrodes and not through the nipple.

In accordance with the preferred embodiment of the present invention it is suggested to provide a twin wall conical sleeve for purposes of cooling a connector nipple, the nipple being connected to one of sections of the electrode to be interconnected; the sleeve is further provided for cooling also the connecting element that is part of or connected to the other electrode section, therefor the twin wall conical sleeve is axially movable to a limited extent and extends axially by means of an inner wall along most of the periphery of that part of the nipple which projects beyond the lower electrode section, and will abut the surface to be cooled. The connector element is preferably constructed as a conical receiver for the upper part of the nipple, and the sleeve should be provided with pressure elements which moves the cooling sleeve axially in the direction of the lower electrode section until the sleeve abuts the receiver.

The nipple and the connecting element are therefore intensively cooled through contact pressure which is effective over the entire conical surface of the sleeve. There are of course provided water connections to the sleeve, but they do not have to be released when connection or disconnection as between the nipple and the connecting receiver is desired. The electrode is preferably constructed in a twin wall configuration so that the resulting cooling space can be connected to a general circulation of coolant.

DESCRIPTION OF THE DRAWING

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

The FIGURE illustrates a cross-section through an example of the preferred embodiment of the present invention for practicing the best mode thereof.

Proceeding now to the detailed description of the drawings, reference numeral 1 refers generally to the lower part of an electrode and a double cone or twin cone nipple 2 is threaded into the lower electrode part 1. In addition, the upper part of the nipple 2 is threaded to a frustoconical receiver 3. Therefore, the nipple is connected in a form fitting relationship to these two parts.

The upper electrode part or tubular section 9 is constructed as a twin wall element i.e. it has an inner wall and an outer wall and hollow space in between, and its front face 9a abuts the upper front end 1a of the lower electrode section 1 made, for example, of graphite.

A tension rod 14 is provided having a connecting section 15 to which are articulated or pivotally hinged a pair of claw elements or gripping arms 12. These elements or arms 12 have bracket portions 16 which receive and enclose a twin cone plug 20 which extends through a holding arm 22 from the receiver 3. This way then a positive connection is provided between the tension rod 14 and the receiver 3 into which is threaded the upper end of the nipple element 2. The pivoted arms 12 are held in gripping position by a ring 7.

It can thus be seen that if tension is applied to the tension rod 14, the electrode 1 through the connection including the nipple 2 is forced with its surface 1a against the surface 9a of the upper electrode section. More particularly, upon pulling the tension rod 14 up the receiver 3 with its conical outer surface slides into a conical opening of a cooling sleeve 5 which hangs on conduits 11 and 13. This cooling sleeve 5 is guided and held in relation to a guide ring 7 through guide rods 8. Springs 6 force the sleeve 5 against the receiver 3 so that the abutment surfaces of the receiver 3 and of the cooling sleeve 5 are in good physical contact.

The sleeve 5 itself is illustrated to be of twin wall construction having internal chambers, there being partitions or flow deflection vanes 4. The conduits 11 and 13 provide cooling water to and from the interior of the sleeve respectively. In other words, the interior chamber of the cooling sleeve 5 is connected through the conduit 11 and 13 into a coolant flow circulation. The conduits 11 and 13 each are provided with a small section, 10, that is corrugated and provides for length compensation on account of the possible axial displacement of parts in relation to each other. This will become effective particularly as the tension rod 14 pulls everything up. The conduit 11 is freely passing through the holding ring 7 that is secured to the inside of the tubular electrode section 9, and remains stationary in this regard. Since the sleeve 5 is a separate unit, it can remain connected to its conduits 11, 13 even when nipple 2 is unthreaded from 2 or 3 or both.

The particular corrugated tube portions 10 may be designed so that in addition to the aforementioned compensation they are also capable of causing the axial movement of the sleeve 5 in direction towards lower electrode section 1, which is presently caused (or augmented) by spring 6 being interposed between an upper front face of the sleeve 5 and a lower surface of the ring 7. The partitions 4 in the cooling structure 5 provide for adequate deflection of the coolant flow in order to enhance cooling efficiency. The reference numeral 21 refers to the cooling chamber established through the space between concentric walls of tubualar electrode section 9.

The invention is not limited to the embodiments described above, but all changes and modifications thereof not constituting departures from the spirit and scope of the invention are intended to be included.

We claim:

1. In a connection device between an upper hollow metallic electrode section and a lower electrode section, there being a connecting nipple form fittingly connected to the lower electrode section and being form fittingly connected to a tensioned receiver for urging the lower electrode section against the upper electrode section, a cooling structure comprising:

a twin wall sleeve with a conical inner wall and having an integral cooling space between the inner wall and an outer wall and being arranged around said receiver for receiving said receiver, there being means for feeding cooling fluid to and extracting coolant fluid from the internal cooling space of said conical sleeve so as to obtain cooling of the nipple through the receiver; and means holding said twin wall sleeve within said upper electrode section permitting limited axial displacement therein as well as in relation to said receiver it receives, said sleeve as receiving said receiver and indirectly said nipple, having axial dimensions so as to cover most of the portions of the nipple which project axially from the lower electrode section.

2. The structure as in claim 1 and including a ring mounted in said hollow section, and tension means interposed between said ring and said cooling sleeve.

3. The structure as in claim 2, said tension means including a spring interposed between said ring and said sleeve.

* * * * *